US006325964B1

(12) United States Patent
Chan et al.

(10) Patent No.: US 6,325,964 B1
(45) Date of Patent: Dec. 4, 2001

(54) METHOD OF MANUFACTURING HIGH-DENSITY TITANIUM ALLOY ARTICLE

(75) Inventors: Jean Chan, Chungli; Chin-Liang Cheng, Hsinchu, both of (TW)

(73) Assignee: New Century Technology Co., Ltd., Hsinchu (TW)

( * ) Notice: Subject to any disclaimer, the term of this patent is extended or adjusted under 35 U.S.C. 154(b) by 0 days.

(21) Appl. No.: 09/664,998

(22) Filed: Sep. 18, 2000

(51) Int. Cl.[7] ..... B22F 3/12
(52) U.S. Cl. ..... 419/32; 419/39
(58) Field of Search ..... 419/32, 39

(56) References Cited

U.S. PATENT DOCUMENTS 4,478,790 * 10/1984 Huther et al. ..... 419/54
5,773,099 * 6/1998 Tanaka et al. ..... 427/529
5,977,033 * 10/1999 Lefebvre et al. ..... 508/551
6,106,412 * 8/2000 Kosugi et al. ..... 473/305

* cited by examiner

*Primary Examiner*—Ngoclan Mai
(74) *Attorney, Agent, or Firm*—LaRiviere, Grubman & Payne, LLP

(57) ABSTRACT

A method of manufacturing a high-density titanium alloy article is disclosed. The method comprises a mixing and granulating step, a high-pressure molding step, and a high-temperature sintering step. Moreover, by means of selecting proper size of titanium raw powder and granulating the titanium raw powder and other metallic powder into titanium-based grains, a titanium alloy article having a high density is obtainable.

13 Claims, 1 Drawing Sheet

METHOD OF MANUFACTURING HIGH-DENSITY TITANIUM ALLOY ARTICLE

BACKGROUND OF THE INVENTION

1. Field of the Invention

This invention relates to a method of manufacturing a titanium alloy article, and particularly to a method of manufacturing a titanium alloy article by means of a powder metallurgy sintering method.

2. Description of the Prior Art

Titanium is a material of high strength, lightweight, and highly anticorrosive. In the prior art, a titanium alloy article can be manufactured by methods such as casting, powder metallurgy (P/M) sintering, and sheet pressing. The casting method results in an alloy article of high strength but with an unstable quality, a bad throughput, and a high cost. The conventional powder metallurgy sintering method has disadvantages such as a low density, an insufficient tensile strength and extensibility. The sheet pressing method has disadvantages such as a high mold-wearing rate, a poor changeability in shape, and a poor accuracy, due to the high hardness of the titanium alloy. By means of the sheet pressing method, right-angle portions of an article are not as good as expected.

As far as the conventional powder metallurgy sintering method is concerned, in addition to a conventional powder-compression-molding method, a powder-inject-molding method has been proposed to overcome the disadvantage of insufficient strength. The conventional powder-compression-molding method needs a large amount of lubricant, serving as a disengaging agent, to easily release an unbaked article from a die and to prevent the die from becoming jammed. However, since the lubricant cannot be completely expelled from the titanium alloy article in the conventional powder metallurgy sintering method, the density of the sintered titanium alloy article is relatively low. The powder-inject-molding method uses titanium powder of smaller diameter as well as a large amount of lubricant much more than in the powder-compression-molding method. To expel the lubricant, a chemical method incorporated with particular equipment has ever been proposed. However, such a chemical method is costly and requires a long processing time. In addition, the titanium alloy article produced by such a sintering and chemical method can only have a density of no more than 95% of theoretical density and a strength inferior to that of the casting method.

On the other hand, with various superior properties, titanium alloy has been applied to various articles such as the frame for glasses and the hitting face of a golf club. In the case of the hitting face, a titanium hitting face manufactured by the casting and cutting method is very expensive. As for the use of the pressing method to alternatively manufacture the hitting face, it has a problem to obtain a well-defined shape. This is one of the reasons that a stepped edge is necessary for a hitting face and the stepped angle for the stepped edge should be very precise so that the hitting face can be fit into a head of a club. Moreover, in case a hitting face is manufactured by the conventional powder metallurgy sintering method, the hitting face is of insufficient strength. Thus, the conventional sintering method is not appropriate to produce a high-quality hitting face. In view of the above, the existing manufacturing methods cannot produce a titanium alloy article having high stability, a more precise pattern, high strength, and high density at a low cost, especially for a hitting face of a club.

SUMMARY OF THE INVENTION

An object of this invention is to provide a method of manufacturing a titanium alloy article having a precise pattern and a high strength at a low cost.

To achieve the above object, the present invention discloses a method of manufacturing a high-density titanium alloy article, comprising:

- a mixing and granulating step for mixing titanium powder with other metal powder and granulating the mixed powder into titanium-based grain;
- a high-pressure molding step for compressing the granulated titanium-based grain into a particular pattern of unbaked article; and
- a high-temperature sintering step for heating the unbaked article at a high temperature so as to form a titanium alloy article.

By means of the above method, since the titanium powder and the other metal powder are mixed and granulated first and then compressed into an unbaked article at a high pressure, the problem of the die jamming can be avoided and a high-density sintered titanium alloy article could be obtained in light of the fact that the binder agent and the lubricant mixed into the unbaked article are completely removed. Moreover, the diameter of the titanium-based grain is preferably larger than 150 mesh, the compressing pressure is preferably higher than 2.8 Ton/cm$^2$, and the temperature for sintering is preferably higher than 1200° C. In view of the above conditions, a titanium alloy article having a density near 99% of theoretical density is obtainable.

The advantages and features of this invention can be easily comprehended by persons skilled in the art through the drawings and detailed explanations.

DETAILED DESCRIPTION OF EMBODIMENTS

Figure 1:
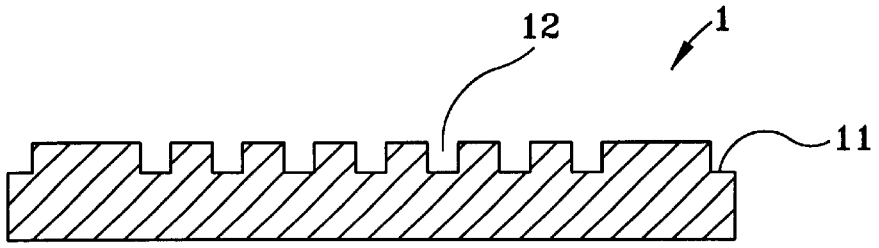
FIG. 1 illustrates a sectional view of a hitting face of a golf club which is adapted to be manufactured by the method according to this invention.

FIG. 1 shows a hitting face of a golf club which is especially adapted to be manufactured by the method according to this invention. As shown in FIG. 1, the periphery of the hitting face 1 is provided with a stepped recess 11 for matching with a club head (not shown). Moreover, many grooves 12 formed on the surface of the hitting face 1 are used to increase friction. Furthermore, the inner angles of the stepped recess 11 and the grooves 12 are substantially at a right angle.

Figure 2:
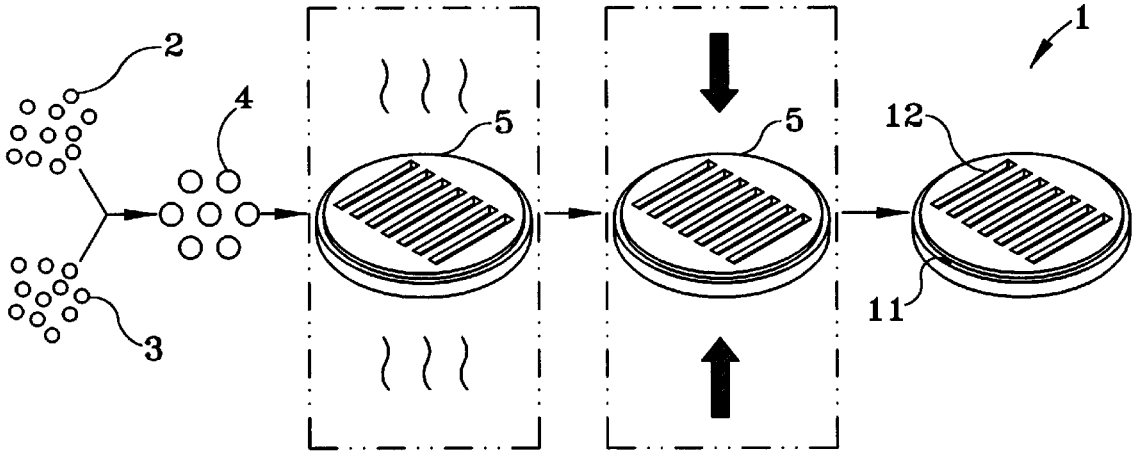
FIG. 2 illustrates a flow chart showing the method according to this invention.

FIG. 2 shows a flow chart of the method according to this invention. As shown in FIG. 2, the method of manufacturing a titanium alloy article according to this invention is described as follows by way of an illustration of a hitting face of a club. First, titanium powder 2 and other metallic powder 3 such as aluminum powder and vanadium powder are mixed and granulated into a titanium-based grain 4, in which the titanium powder is preferably 90 weight %, and the aluminum powder and the vanadium powder is 6 weight % and 3 weight % respectively. Moreover, the diameter of the titanium powder 2 is preferably smaller than 45 $\mu$m (325 mesh), and its chlorine containment is preferably below 0.15%. Furthermore, to avoid the problem of the die jamming, the diameter of the titanium-based grain 4 is preferably larger than 150 mesh.

Figure 3:
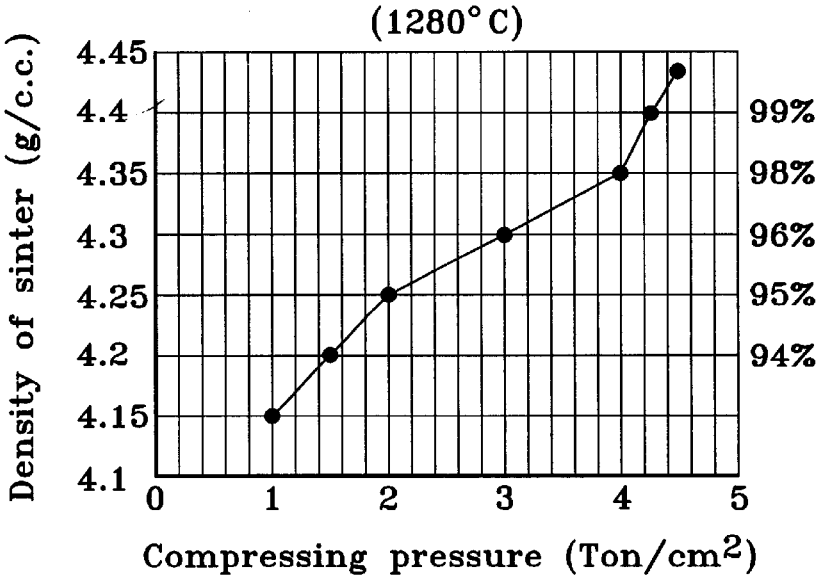
FIG. 3 illustrates a diagram showing the relationship between the molding pressure and the density of the sintered titanium alloy article at a certain temperature.

Second, the titanium-based grain 4 is compressed by a die (not shown) at a high pressure into an unbaked hitting face for a golf club as shown in FIG. 2. As shown in FIG. 3, a titanium-alloy-based hitting face having a density of 99% of theoretical density, i.e., 4.4 g/cm$^3$, after being sintered at a predetermined temperature is obtainable if the compressing pressure is at a value of 4.4 Ton/cm$^2$. In fact, when the compressing pressure is larger than 2.8 Ton/cm$^2$, a density of 96% of theoretical density is obtained, which is superior to that of the conventional sintering method.

To combine the materials in the unbaked hitting face uniformly and to expel the binder and the lubricant contained therein, a sintering process at a high temperature is performed in sequence. The sintering process is preferably carried out in a vacuum atmosphere. Experiments reveals that when the sintering temperature is higher than 1200° C., and a heat treatment at a temperature of 520° C. for 8 hours is followed, a titanium alloy article having a density above 99% of theoretical density is obtained at the foresaid compressing pressure.

With a test to the sintered titanium alloy article made by the above method, data shown in Table 1 is obtained. In Table 1, the properties of the titanium alloy article manufactured by a conventional casting method are also listed for comparison.

TABLE 1

| | This invention | Conventional casting |
|---|---|---|
| Density | 4.4 g/cm3 | 4.4 g/cm3 |
| Tensile strength | 130 ksi | 136 ksi |
| Extensibility | 129 ksi | 120 ksi |
| Hardness | HRC 37–42 | HRC 35–40 |

From Table 1, it can be found that the density of the titanium alloy article made by this invention can reach the level of that manufactured by the conventional casting method, while the hardness of the present invention is higher than that of the conventional method, and so is the extensibility. Therefore, in addition to the properties, this invention is superior to the conventional casting method in manufacturing cost, throughput, and stability, and thus is more useful.

In view of the above, a hitting face of good properties and strike-sustainable is obtained. Of course, the method of manufacturing a titanium alloy article can be applied where high density and high strength are needed, such as wheel rims. Therefore, though the hitting face is illustrated as an example, the articles to be manufactured by this invention are not limited to the hitting face of a golf club.

While the present invention is described by way of preferred embodiments, it should be understood that the embodiments are used only to illustrate the technical concept of the present invention without limiting the scope thereof. Therefore, all modifications and alterations that are readily apparent to those skilled in the art shall fall within the scope of this invention as defined in the appended claims.

What is claimed is:

1. A method of manufacturing a high-density titanium alloy, comprising:

mixing titanium powder with other metal powder and granulating the mixed powder into titanium-based grain;

compressing the granulated titanium-based grain into a particular pattern of unbaked article; and heating the unbaked article at a high temperature so as to form a titanium alloy article.

2. The method as claimed in claim 1, wherein the diameter of the titanium-based grain is larger than a 150 mesh.

3. The method as claimed in claim 1, wherein the compression pressure is larger than 2.8 Ton/cm$^2$.

4. The method as claimed in claim 1, wherein the sintering temperature is larger than 1200° C.

5. The method as claimed in claim 1, the diameter of the titanium powder is of a diameter smaller than a 325 mesh.

6. A method of manufacturing a high-density titanium alloy, comprising:

mixing titanium powder with other metal powder and granulating the mixed powder into a titanium-based grain having a diameter larger than a 150 mesh;

compressing the granulated titanium-based grain into a particular pattern of unbaked article; and heating the unbaked article at a high temperature so as to form a titanium alloy article.

7. The method as claimed in claim 6, wherein the compression pressure is larger than 2.8 Ton/cm$^2$.

8. The method as claimed in claim 6, wherein the sintering temperature is larger than 1200° C.

9. The method as claimed in claim 6, wherein the diameter of the titanium powder is of a diameter smaller than a 325 mesh.

10. A method of manufacturing a high-density titanium alloy, comprising:

mixing titanium powder with other metal powder and granulating the mixed powder into titanium-based grain;

compressing the granulated titanium-based grain into a particular pattern of unbaked article at a compression pressure of larger than 2.8 Ton/cm$^2$; and heating the unbaked article at a high temperature so as to form a titanium alloy particle.

11. The method as claimed in claim 10, wherein the diameter of the titanium-based grain is larger than 150 mesh.

12. The method as claimed in claim 10, wherein the sintering temperature is larger than 1200° C.

13. The method as claimed in claim 10, wherein the diameter of the titanium powder is of a diameter smaller than a 325 mesh.

* * * * *